US005702009A

United States Patent [19]

Ouellet et al.

[11] Patent Number: 5,702,009

[45] Date of Patent: Dec. 30, 1997

[54] BOTTLE HOLDER

[76] Inventors: Gilles Ouellet; Debra Ouellet, both of 332 Maple Str., Russell, Ontario, Canada, K4R 1B4

[21] Appl. No.: 618,802

[22] Filed: Mar. 20, 1996

[30] Foreign Application Priority Data

Sep. 18, 1995 [CA] Canada ..... 2158492

[51] Int. Cl.[6] ..... A47F 7/00

[52] U.S. Cl. ..... 211/74

[58] Field of Search ..... 211/74, 71, 60.1

[56] References Cited

U.S. PATENT DOCUMENTS

| | | | |
|---|---|---|---|
| 3,860,048 | 1/1975 | White | 211/74 X |
| 4,271,878 | 6/1981 | Bologa | 211/74 X |
| 4,482,522 | 11/1984 | Baudisch et al. | 211/74 X |
| 5,036,989 | 8/1991 | Carilli | 211/60.1 X |
| 5,065,966 | 11/1991 | Hartke | 211/74 X |
| 5,285,907 | 2/1994 | Franchere et al. | 211/74 |
| 5,579,929 | 12/1996 | Schwartz | 211/74 |

*Primary Examiner*—Alvin C. Chin-Shue
*Assistant Examiner*—Sarah L. Purol

[57] ABSTRACT

A bottle holder, for holding the neck of an inverted bottle while emptying the bottle or concentrating the bottle contents in the neck, is made as a cube-shaped hollow body having a sidewall on each of five sides defining a cavity which is open at a sixth side. Several of the sidewalls each have a single centrally situated aperture which differs in size from apertures in other sidewalls. The holder is capable of resting on a level surface with a selected one of the apertured sidewalls uppermost, this latter sidewall having an aperture capable of holding the neck of a particular bottle clear of an opposed sidewall. The different sizes of aperture allow the holder to be used with bottles of widely different sizes. The holder may also include an open-topped container suitable for being inserted into the cavity to receive liquid from a bottle.

2 Claims, 1 Drawing Sheet

BOTTLE HOLDER

BACKGROUND OF THE INVENTION

1. Field of the Invention

The present invention relates to holding bottles of different shapes and sizes.

SUMMARY OF THE INVENTION

The bottle holder is a single element, a hollow square-sided box with five side walls, and with one end open and having different sizes of apertures in the sidewalls. It is made of plastic.

More specifically, in accordance with the present invention, a bottle holder for holding the neck of an inverted bottle while emptying the bottle or concentrating the bottle contents in the neck comprises a cube-shaped hollow body having a sidewall on each of five sides defining a cavity which is open at a sixth side, and wherein at least three of said sidewalls each have a single centrally situated aperture which differs in size from apertures in other sidewalls, the holder being capable of resting on a level surface with a selected one of the apertured sidewalls uppermost, the latter sidewall being selected to have a size of aperture capable of holding the neck of a particular bottle clear of an opposed sidewall. The different sizes of the apertures allow the holder to be used with bottles of widely differing sizes.

The bottle holder may also include an open-topped container suitably dimensioned for being inserted into the cavity and capable of receiving fluid from a bottle held by the uppermost sidewall.

To use the bottle holder the aperture is chosen according to the size of bottle, and the bottle is placed upside down in that aperture of the holder. If the bottle top is left on, this inversion concentrates the contents in the neck. If the bottle top is removed, the liquid can drip into the open-topped container.

The purpose of the bottle holder is to empty bottles without a user holding them to prevent spills, and save valuable time.

The bottle holder can be used anywhere, anytime. It is a time saver and energy saver, it can be used by all ages.

The invention, as exemplified by a preferred embodiment, is described with reference to the drawings in which:

DESCRIPTION OF THE PREFERRED EMBODIMENT

Figure 1:
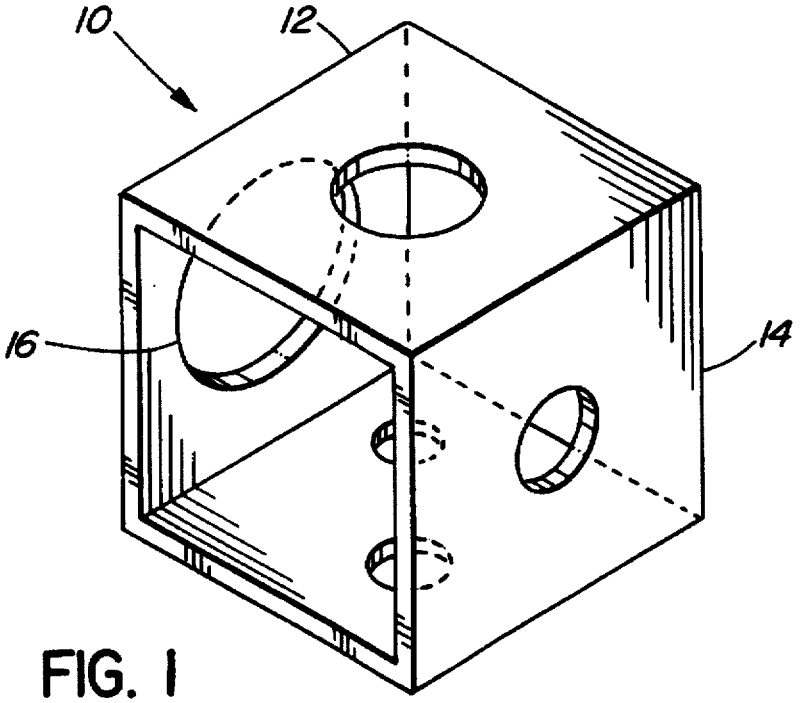
FIG. 1 is a perspective view of an embodiment of a bottle holder of the invention.

Referring to drawings, FIG. 1 shows, a bottle holder 10 which comprises a box or cube-shaped frame 12. The holder has five sidewalls 14 which define a cavity which is open at the sixth side. As may be seen in FIG. 1, the sidewalls have different sizes of apertures 16.

Specifically, as will be clear from the drawing, three adjacent sidewalls each have a single centrally placed circular aperture which differs in size from apertures of adjacent sidewalls. The fourth sidewall has two small apertures, while the rear sidewall is unapertured.

Figure 2:
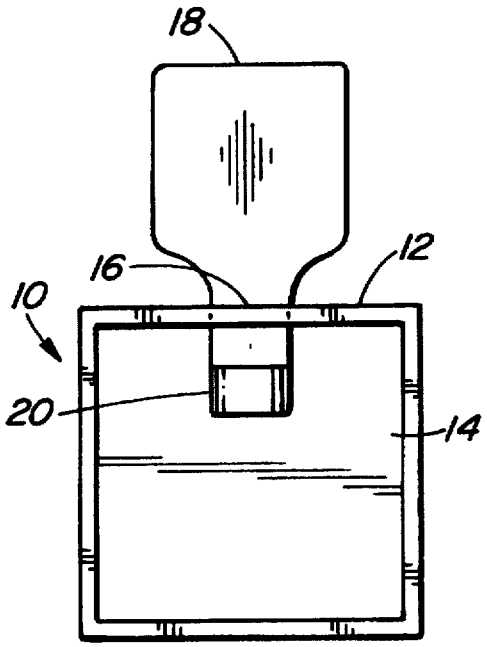
FIGS. 2 & 3 are front views demonstrating the use of bottle holder.

As may be seen m FIG. 2, a bottle 18 inserted upside down into a chosen aperture 16, the with the top on 20 is ready to be used. It will be evident that in this condition the bottle is merely held ready for use while its contents become concentrated in the neck.

Figure 3:
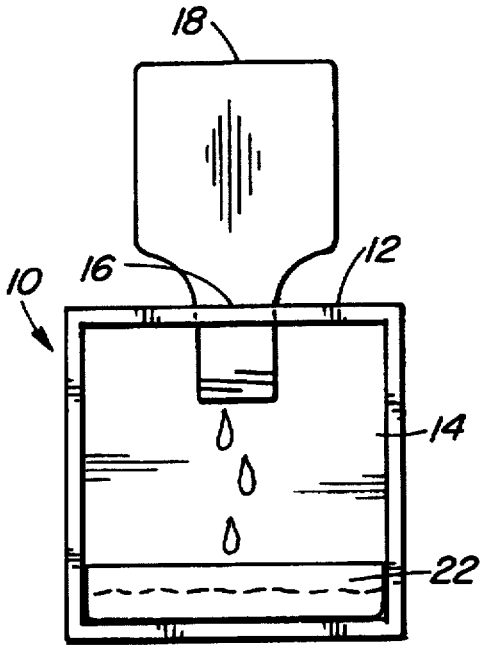

As may be seen in FIG. 3, a bottle 18 with the top may be inserted upside down 18 in a chosen aperture 16 so as to empty itself into the open-topped container 22 which is placed in the cavity of the holder.

Although only a single embodiment of the present invention has been described and illustrated, the present invention is not limited to the features of this embodiment but includes all modification within the scope of the claims.

The embodiments of the invention in which and exclusive property or privilege is claimed are define as follows:

1. A bottle holder for holding the neck of an inverted bottle while emptying the bottle or concentrating the bottle contents in the neck, comprising a cube-shaped hollow body having a sidewall on each of five sides defining a cavity which is open at a sixth side, and wherein at least three of said sidewalls each have a single centrally situated aperture which differs in size from apertures in other sidewalls, the holder being capable of resting on a level surface with a selected one of said apertured sidewalls uppermost, said last-mentioned sidewall being selected to have a size of aperture capable of holding the neck of a particular bottle clear of an opposed sidewall; said different sizes of aperture allowing the holder to be used with bottles of widely differing sizes; said bottle holder further comprising an open-topped container suitable dimensioned for being inserted into said cavity and capable of receiving fluid from a bottle held by said uppermost sidewall.

2. Apparatus for draining fluid from a bottle, comprising:

a bottle holder for holding the neck of said bottle when inverted, comprising a square sided hollow body having a sidewall on each of five sides which sidewalls define a cavity which is open at a sixth side, and wherein several of said sidewalls each have an aperture which differs in size from apertures in other sidewalls, the holder being capable of resting on a level surface with a selected one of said apertured sidewalls uppermost, said uppermost sidewall being selected to have a size of aperture capable of holding the neck of a said bottle clear of the opposed lowermost sidewall; and an open-topped container suitably dimensioned for being inserted into said cavity and capable of receiving fluid from said bottle while held inverted by the uppermost sidewall.

* * * * *